US006318471B1

(12) United States Patent
Raines

(10) Patent No.: US 6,318,471 B1
(45) Date of Patent: Nov. 20, 2001

(54) METHOD FOR INSTALLING TUBULAR MEMBERS AXIALLY INTO THE EARTH

(75) Inventor: Richard D. Raines, Houston, TX (US)

(73) Assignee: ExxonMobil Upstream Research Co., Houston, TX (US)

( * ) Notice: Subject to any disclaimer, the term of this patent is extended or adjusted under 35 U.S.C. 154(b) by 0 days.

(21) Appl. No.: 09/594,241

(22) Filed: Jun. 15, 2000

Related U.S. Application Data

(63) Continuation of application No. 09/444,174, filed on Nov. 19, 1999, now Pat. No. 6,102,119, and a continuation of application No. 08/655,482, filed on May 30, 1996, now Pat. No. 5,815,652.

(60) Provisional application No. 60/109,932, filed on Nov. 25, 1998.

(51) Int. Cl.[7] ..... E21B 23/00

(52) U.S. Cl. ..... 166/381; 166/73; 166/69; 166/115; 166/177.6; 166/242.1; 166/249; 175/22; 405/8

(58) Field of Search ..... 166/244.1, 71, 166/73, 207, 381, 69, 70, 115, 165, 177.6, 242.1, 249; 175/19, 20, 22; 405/8

(56) References Cited

U.S. PATENT DOCUMENTS

| | | | |
|---|---|---|---|
| 3,167,924 | 2/1965 | Barcus et al. | 61/53.72 |
| 3,174,290 | 3/1965 | Maloney et al. | 61/53.72 |
| 3,232,061 | 2/1966 | Davis et al. | 61/53.72 |
| 3,264,834 | 8/1966 | Guild | 61/53.72 |
| 3,269,127 | 8/1966 | Rusche | 61/53.72 |
| 3,269,128 | 8/1966 | Rusche | 61/53.72 |
| 3,327,483 | 6/1967 | Gibbons | 61/53.7 |
| 3,329,216 | 7/1967 | Warrington et al. | 173/132 |
| 3,335,574 | 8/1967 | Guild | 61/53.72 |
| 3,604,214 * | 9/1971 | Turzillo . | |
| 3,825,082 * | 7/1974 | Woodruff . | |
| 3,916,634 * | 11/1975 | Woodruff . | |
| 3,984,992 | 10/1976 | Merjan | 61/53.72 |
| 4,036,025 | 7/1977 | Guild | 61/53.72 |
| 4,102,141 | 7/1978 | Ingalls | 61/53.5 |
| 4,138,199 | 2/1979 | Gendron et al. | 405/232 |
| 4,154,307 | 5/1979 | Gendron et al. | 173/21 |
| 4,702,325 | 10/1987 | Hipp | 173/64 |
| 5,082,069 | 1/1992 | Seller et al. | 175/5 |
| 5,379,844 | 1/1995 | Glasscock et al. | 166/358 |
| 5,456,326 | 10/1995 | Raines | 175/57 |
| 5,540,294 | 7/1996 | Anderberg | 175/19 |
| 5,542,784 | 8/1996 | Gardenberg | 405/232 |
| 6,102,119 * | 8/2000 | Raines | 166/244.1 |

FOREIGN PATENT DOCUMENTS

| | | | |
|---|---|---|---|
| 713780 | 7/1965 | (CA) | 61/73 |
| 713781 | 7/1965 | (CA) | 61/73 |
| 728884 | 3/1966 | (CA) | 61/78.4 |
| 1063369 | 10/1979 | (CA) | 61/88 |
| 1 022 943 | 3/1966 | (GB) | E02D/7/06 |
| 2 099 053 A | 12/1982 | (GB) | E02D/7/06 |
| 1 599 899 | 10/1981 | (GB) | E02D/7/12 |

* cited by examiner

*Primary Examiner*—Roger Schoeppel
(74) *Attorney, Agent, or Firm*—Kelly A. Morgan

(57) ABSTRACT

A method is disclosed for installing a tubular member, having an upper end and a closed lower end, axially into and through an over-pressured region of the earth by using a mandrel to drive the tubular member from near the bottom, which results in a significant section of the tubular member being pulled through the over-pressured region. In another embodiment, a filler material is inserted into at least a portion of the tubular member, and the tubular member is driven from the upper end, with the filler material assisting the progression of the tubular member through the over-pressured region.

17 Claims, 7 Drawing Sheets

METHOD FOR INSTALLING TUBULAR MEMBERS AXIALLY INTO THE EARTH

This application is a Continuation of U.S. application Ser. No. 09/444,174 filed Nov. 19, 1999 now U.S. Pat. No. 6,102,119.

This application is a continuation of Ser. No. 08/655,482 May 30, 1996 U.S. Pat. No. 5,815,652 which claims benefit of No. 60/109,932 Nov. 25, 1998.

FIELD OF THE INVENTION

This invention relates generally to the installation of tubular members, such as well conductors, foundation piles, drive pipes and well casings axially into the earth. More particularly, but not by way of limitation, the invention pertains to a method for installing tubular members through at least one over-pressured region of the earth.

BACKGROUND OF THE INVENTION

In the oil and gas industry, tubular members installed axially into the earth are used for a variety of purposes. For example, tubular members are frequently used as foundation piles to support the weight of an offshore structure and to resist environmental loads applied to the structure. Tubular members are also used as well conductors to facilitate the drilling of wells from an offshore platform. Other uses of tubular members will be well known to those skilled in the art.

Typically, the objective is to install the open-ended tubular member into the earth a distance, known as the target penetration, which is sufficient to mobilize the required load carrying capacity of the tubular member. Failure to mobilize the desired load carrying capacity of a tubular member means that the installed tubular member may not be fit for its intended purpose because it may not be able to resist the applied loads. If the tubular member is a well conductor, another objective is to preclude soil fracture during subsequent drilling operations. The ability of the subsurface soils to withstand fracture is known as "fracture integrity". Fracture integrity may be either local or global. Local fracture integrity refers to the ability of the soils to withstand fractures along the interface between the conductor and the surrounding soils. Global fracture integrity refers to the ability of the soils to withstand fractures at some distance from the wall of the conductor or below the top of the conductor. Compromising the fracture integrity of the surrounding soils can lead to lost returns and, potentially, to loss of the well during subsequent drilling operations.

Generally, there are two fundamental ways in which a tubular member may be installed into the earth. First, the tubular member may be installed into the earth in the manner of conventional piles. Second, a borehole may be drilled into the earth and the tubular member cemented therein. The drilling of wells in the deep waters of the Gulf of Mexico ("GOM") is often problematic because of the presence of over-pressured (excess water pressure) sands or soils which are often found at relatively shallow depths [e.g., 1000 to 2000 feet below the mudline ("BML")]. These sands and/or soils may be deposited in one or more layers or regions (not by way of limitation, these regions are hereinafter referred to as "sand regions" and can include sand, soil or a mixture thereof) and are typically surrounded by clays that are normally to under-consolidated. A conventional tubular well casing with an open flow area typically cannot penetrate deep enough to drive through the over-pressured sand region (or through multiple over-pressured sand regions) as well as through a sufficient interval of the overlying and underlying clays to maintain adequate pressure integrity both above and below the over-pressured sand region(s). The penetration of a conventional driven casing is generally limited because of a combination of low driving impedance and insufficient hammer energy. Driving impedance is a measure of the transmissibility of a stress wave through a medium, in this example the well casing. It is defined by the equation: $I_d$=EA/c, where $I_d$=driving impedance, E=modulas of elasticity of the medium, A=cross-sectional area; and c=wave speed. As described further below, a conventionally driven standard tubular casing with an open flow area will not likely be satisfactory for driving through over-pressured sand regions.

Drilling through over-pressured sand regions with conventional methods will often result in sand and water flowing to the mudline both through the flow area of the well casing and the interface between the well casing and the formation. These incidents of sand flow can result in loss of casing support and the wells due to buckling and possible subsidence of the seafloor. Should significant sand flow occur after siting the production facility, the resulting subsidence may adversely affect the capacity of the foundation and may ultimately lead to catastrophic foundation failure or abandoning the facility. The consequences of these outcomes can result in significantly higher drilling and production costs and lost income. It is conceivable that under extreme conditions it may not be economical to produce a field because of this problem.

The current technology for drilling through over-pressured sand regions uses a combination of three-dimensional ("3-D") high-resolution shallow seismic data and standard well drilling techniques that are adapted to the geological conditions. The state of the practice is to identify with the 3-D data the aerial extent of the over-pressured formation and to either avoid the formation or select a location where the over-pressured region is thinnest. It is not possible however to determine the relative pressure in the formation with seismic data. Accordingly, once the drilling location is chosen, drilling proceeds conventionally with emphasis on drilling through the over-pressured sand layers as quickly as possible using drilling mud or seawater with gel sweeps.

When attempting to drill with mud at equilibrium conditions (no flow in or out of the borehole), efforts are made to control any over-balance zones (where sand flows into the borehole) in the formation by injecting heavy mud (dynamic kill). Other drilling technology that has been tried includes injecting a monomer or polymer cement into the over-pressured sands to stem the water flow prior to drilling the casing hole. After drilling is complete, the casing string is cemented to the formation and to the prior casing strings in the conventional manner to prevent flows around the outside of the casing and within the annulus between casing strings.

Practically speaking, it may not be possible to obtain equilibrium of fluid pressures in the borehole even using a riser, because the equilibrium pressure may be very close (within 0.5 lb./gal.) to the fracture pressure. Exacerbating this condition may be several thousand feet of drill cuttings in the fluid column that cannot be precisely controlled and add to the mud weight. Thus, if the borehole fluid pressure is less than the formation pressure, sand flows into the borehole and wellbore stability is a problem. If the borehole fluid pressure is greater than the formation pressure, then the fluid pressures in the borehole will fracture or liquefy the sand formation. Ultimately, this could lead to communication between wells or to fluid pressures well in excess of hydrostatic reaching higher elevations and subsequently fracturing the formation to the seafloor. If this fracture intersects the foundations, premature failure of the foundation could occur.

Controlling the wellbore fluids to achieve pressure equilibrium is not sufficient to assure well and foundation integrity. An adequate cement bond is necessary between the casing and the borehole walls to prevent broaching of the over-pressured sands along the outside of the casing and to the seafloor. Standard well drilling practice is to drill a borehole larger than the casing and then to fill the void between the casing and the soil with cement. Current cementing technology does not assure that this void can be adequately filled, unless the hole is near gage. This is particularly critical for wellbores that have experienced flow or wall instability since an irregular wall profile exacerbates cementing difficulties and the lack of an adequate cement job may result in buckling of the well casing. When drilling underbalanced (i.e., not sufficient drilling fluid weight to prevent inflow of formation fluids) in granular soils the formation fluid will flow into the wellbore transporting the formation soils. If a sufficient volume of soil is removed over a sufficient interval of casing and a compressive force is then applied to the casing, the casing will buckle. This series of events occurred during the drilling of production wells at a deepwater GOM location, resulting in the site being abandoned.

For the foregoing reasons, installation of a tubular member through one or more over-pressured sand regions of the earth can be difficult to achieve and time consuming using current methods. There can also-be significant adverse consequences resulting from installing tubular members through these over-pressured regions, such as compromising the fracture integrity of the formation or subsidence of the sea-floor. The present invention is aimed at providing a practical, economical and time efficient method for installing tubular members through over-pressured sand region(s) of the earth which will prevent sand or soil flow during installation and assure long term integrity of the well and production facility foundation.

SUMMARY OF THE INVENTION

The present invention is directed toward a new method for installing tubular members, for example well conductors or piles, through one or more over-pressured sand regions of the earth. More specifically, but not by way of limitation, the invention and its various embodiments described herein permit the controlled driving of tubular members into and beyond the over-pressured sand formations found, for example, in the deep waters of the Gulf of Mexico. The invention achieves its objectives by increasing the depth a tubular member can be driven beyond that obtained with current oil field technology and by preventing the flow of fluid into the tubular member from the over-pressured sand or soil formation.

In one embodiment, the method of installing a tubular member axially through at least one over-pressured sand region of the earth comprises drilling a borehole to a depth proximate the top of, but not into, the over-pressured sand region. The tubular member, having an open upper end and a closed lower end, is then inserted into the borehole such that the closed lower end of the tubular member is positioned proximate the top of the over-pressured sand region. The lower end can be closed with for example a pre-installed grout plug, a steel plate or cone, or a soil plug resulting from initial driving through the non-over pressured region. Upon positioning of the tubular member in the borehole, a filler material, comprised of a granular material (which can include a number of different materials such as rock or metal pieces, or cement) is then inserted into at least a portion of the tubular member. A force is then imparted to the upper end of the tubular member or the filler material, or both, whereby an interval of the tubular member, including the lower end, is driven through the over-pressured sand region of the earth. Once the tubular member is driven through the over-pressured sand region, the closed lower end is drilled through. If the tubular member is well casing, then additional casing strings and/or a production tubing string can be installed in the casing for production of hydrocarbons.

In another embodiment, the borehole is drilled, the tubular member is inserted into the borehole as described above, and a force transmission means is installed in the tubular member. The force transmission means extends from a distance above the top of the tubular member to a distance below the top of the tubular member and supports the driving force means. The force transmission means is adapted to transmit a driving force from a point above the upper end of the tubular member to at least one location at or near the lower end of the tubular member. A driving force is then imparted to the force transmission means, whereby an interval of the tubular member, including the lower end, is driven through the over-pressured sand region(s) of the earth. The force transmission means can be comprised of a mandrel and a drive shoe means, where the drive shoe means is connected to the lower end of the tubular member. The drive shoe means can also be pre-installed in the tubular member. The lower end of the tubular member can be closed with a closure plate. Once the tubular member is driven through the over-pressured sand region, the force transmission means can be removed from the tubular member and the closed lower end can then be drilled through. Again, if the tubular member is well casing, then additional casing strings and/or a production tubing string can be installed for production of hydrocarbons.

In both embodiments, the installation of the tubular member through the over-pressured sand region(s) of the formation is achieved by increasing the effective driving impedance of the member, and consequently by increasing the depth the tubular member can be driven with conventional methods.

BRIEF DESCRIPTION OF THE DRAWINGS

The present invention and its advantages will be better understood by referring to the following detailed description and the attached drawings, in which:

FIGS. 5A and 5B illustrate SDR profiles for the composite casing embodiment, mandrel driven casing embodiment and conventional driven casing in the Example I (FIG. 5A) soil stratigraphy and the Example II (FIG. 5B) soil stratigraphy. FIGS. 5C and 5D illustrate SDR profiles for the SDD technology for the Example I (FIG. 5C) soil stratigraphy and the Example II (FIG. 5D) soil stratigraphy.

Figures 1A, 1B, 1C, 1D:
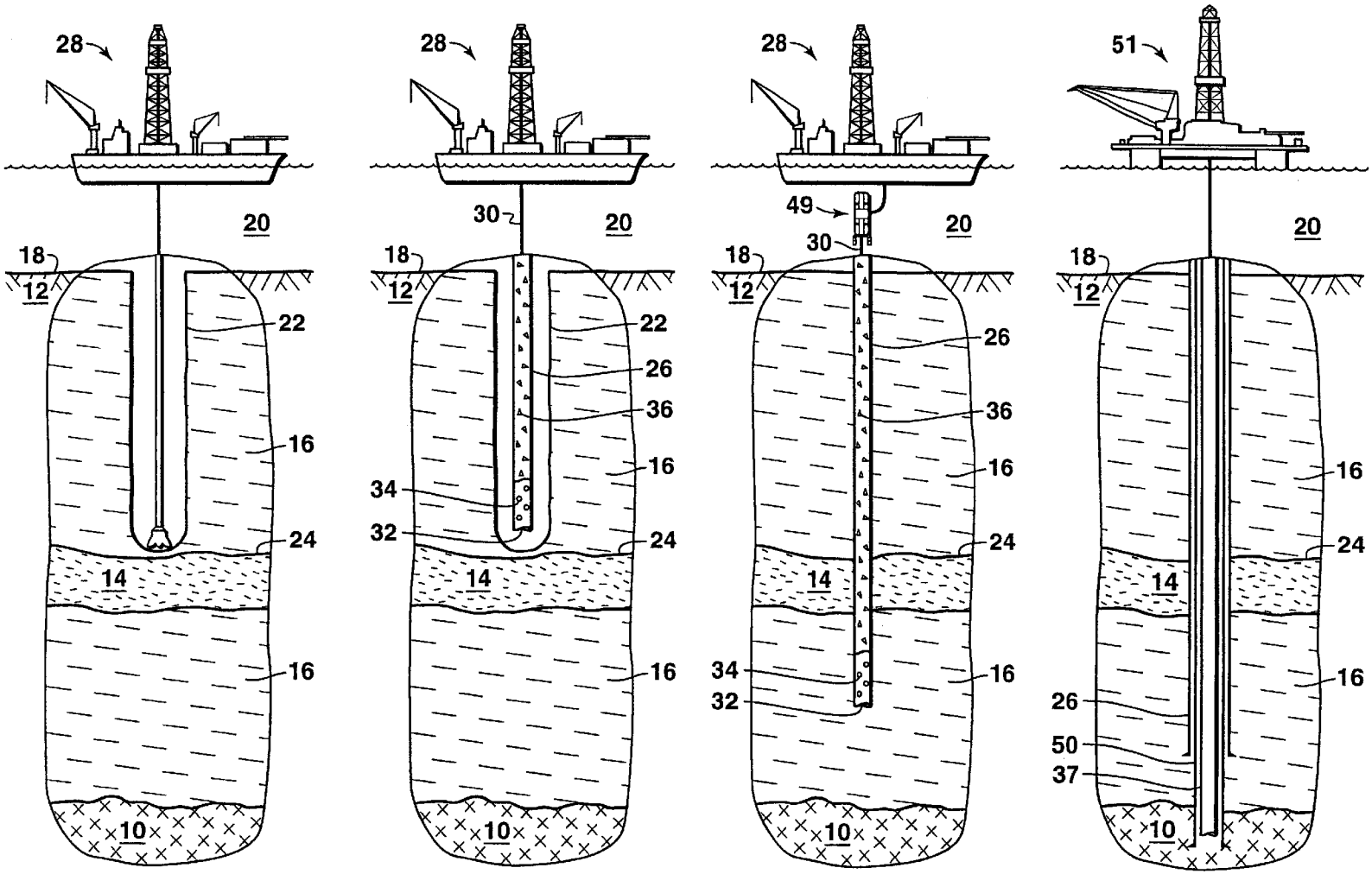
FIGS. 1A through 1D illustrate an exploded view of a first embodiment of the method of the present invention. In this embodiment a filler material is inserted into the tubular member, which is a well casing, an interval of which is driven through the over-pressured sand region.

The invention will be described in connection with its preferred embodiments. However, to the extent that the following detailed description is specific to a particular embodiment or a particular use of the invention, this is intended to be illustrative only, and is not to be construed as limiting the scope of the invention. On the contrary, it is intended to cover all alternatives, modifications, and equivalents which may be included within the spirit and scope of the invention, as defined by the appended claims.

DETAILED DESCRIPTION OF THE INVENTION

The present invention is aimed at providing a practical and economical method for installing tubular members through over-pressured region(s) of the earth to prevent sand or soil flow from occurring around the outside of the tubular member and within the area circumscribed by the annulus of the tubular member during installation and assure long term integrity of, in the case of an oil and gas application, the well and production facility foundation. The various embodiments of the present invention are described herein generically in connection with producing hydrocarbons from a subterranean reservoir located beneath a body of water, and more specifically in the context of permitting the controlled underwater driving of well casing into and beyond the shallow over-pressured sand formations often found for example in the deep waters of the GOM. Although described in this context, the application of this technology is not limited to shallow sand formations, to deepwater applications or to offshore operations. Those skilled in the art will recognize that this invention may be useful in other applications requiring installation of a tubular member into or through at least one over-pressured region of the earth (e.g., installation of foundation piles or a well point drainage system).

Referring now to FIGS. 1A through 1D, a subterranean reservoir 10 is located beneath body of water 20. A drill ship 28 is dynamically positioned or moored to the seafloor 18 for the purpose of drilling and completing wells into the subterranean reservoir 10. Wells may also be drilled from a previously installed offshore structure, such as a steel pile jacket, a tension-leg platform, or a Deep Draft Caisson Vessel ("DDCV") or other production structure. The earth 12 above the reservoir 10 has at least one over-pressured sand region 14 with clay regions 16 located above and below the over-pressured sand region 14. In one embodiment, the method for installing a tubular member axially through the over-pressured sand region 14 of the earth 12 will proceed as follows. An oversized borehole 22 is drilled to a depth proximate the top 24 of, but not into, the over-pressured sand region 14 of the earth 12. For a typical offshore operation, the borehole 22 will be drilled to within about fifty feet of the top 24 of the over-pressured sand region 14. It may be possible to safely drill closer, but oftentimes interbedded, over-pressured sand regions are present (only one region 14 is shown in FIGS. 1A through 1D) which can cause loss of wellbore fluid stability since the wellbore is typically drilled riserless, with seawater and gel sweeps at near hydrostatic pressures.

As illustrated in FIG. 1B, the tubular member 26 (hereinafter for purposes of this illustration referred to as well casing 26), with an upper end 30 and a closed lower end 32, is inserted into the borehole 22 such that the closed lower end 32 of the well casing 26 is positioned proximate the top 24 of the over-pressured sand region 14 of the earth 12. In a typical offshore application, the first one or two casing sections 26 can be hung-off a drilling vessel 28; the remaining sections joined by drivable connectors; and the entire assembly lowered into the predrilled borehole 22. The lower end 32 of the well casing 26 can be closed by pre-installing a cement, grout or concrete plug 34 in the first one or two well casing 26 joints (assuming standard forty feet or longer sections) prior to making the connections to the other well casing 26 joints. The plugs 34 should be cast in a manner to produce a high tensile strength capacity. This may include using high strength cement, expansive cement, prestressing or other techniques or products that will resist tensile stresses during installation.

A filler material 36 is then inserted into at least a portion of the well casing 26. The filler material 36 can for example be cement, grout (cement and sand) or concrete (cement, sand, and rock), subsequently referred to cumulatively as "cement", which is inserted into the well casing 26 by standard tremie procedures (i.e., flowing the cement through a drill string that is inserted into the casing, whereby the cement displaces the seawater upward and out of the casing) after the well casing 26 is lowered into the predrilled borehole 22. The cement is then allowed to cure. An alternate filler material 36 is a loose granular material, such as gravel or sand, which does not need to cure.

Referring now to FIG. 1C, the next step is applying a driving force, with for example an underwater hammer 49, to the upper end 30 of the well casing 26, whereby an interval of the well casing 26, including the lower end 32 is driven through the over-pressured sand region 14 of the earth 12. The closed lower end 32 of the well casing 26 can then be drilled through and one or more additional casing strings 50 and/or a production tubing string 37 can be installed inside the well casing 26 for producing hydrocarbons, as shown in FIG. 1D. Although it may not be necessary for a particular application, the driving force will be most effective if the filler material 36 is inserted to the top of the well casing 26. The driving force can then be applied to both the upper end 30 and the filler material 36 or could be applied to just the filler material 36.

As described above, this embodiment uses driving to install a standard tubular well casing 26 that has inserted therein filler materials 36 such as cement or a granular material. Inserting the filler material 36 increases the driving impedance of the well casing 26. This increased driving impedance permits the 'composite well casing' (i.e., the well casing 26 with the filler material 36 inserted therein) to be driven to a penetration which is greater than the penetration that could be achieved with a standard open-ended tubular well casing. The composite well casing also permits the use of a driving hammer 49 with increased energy, as compared to a standard unfilled casing, because the composite well casing can endure a larger imparted force before yielding of the steel. The capacity to use a driving-hammer 49 with greater energy further increases the amount of soil resistance that can be overcome during driving, thereby increasing the penetration to which the composite well casing can be driven into the formation.

The composite well casing embodiment of the present invention prevents sand flow from an over-pressured sand region 14 both internally and externally. In addition to increasing the penetration to which the well casing 26 can be driven, use of a pre-installed plug 34 seals the casing, preventing sand and water from flowing internally in the casing 26. Flow around the outside of the well casing 26 is also prevented by the natural bond that forms between the wall of a driven well casing 26 and the clay region 16 above and below the over-pressured sand region 14. Consequently the integrity of the formation is maintained. Pressure integrity below the over-pressured sand region 14 is particularly important where multiple over-pressured sand regions exist since communication between sand regions may lead to even higher fluid pressures in the uppermost sand region and ultimately broaching of these fluids to the seafloor 18.

If the filler material 36 is cement, the embodiment described above may be most applicable when there are multiple wells that are batch set (i.e., progressing all the wells concurrently) and the degree of overpressure in the sand region(s) 14 is significant. Using a batch set procedure permits the cement or grout to cure or harden on a non-critical path time and does not influence the production schedule. However, depending on the particular application, an individual well may also require use of the cement-filled embodiment. When the filler material 36 is sand or gravel, time is not required for the material to cure or harden, and therefore this option is also suitable for batch-set or individually drilled wells.

When considering this technology, it is advantageous to select a location with the highest degree of overpressure so that the static-component of driving resistance ("SDR") [which is the portion of the soil resistance to driving that is not rate-dependent] will be reduced the most, and consequently the well casing 26 can be driven to the deepest possible penetration BML. Thus it is worthwhile to measure the degree of overpressure in the formation at several locations prior to using this technology.

Figures 2A, 2B, 2C, 2D:
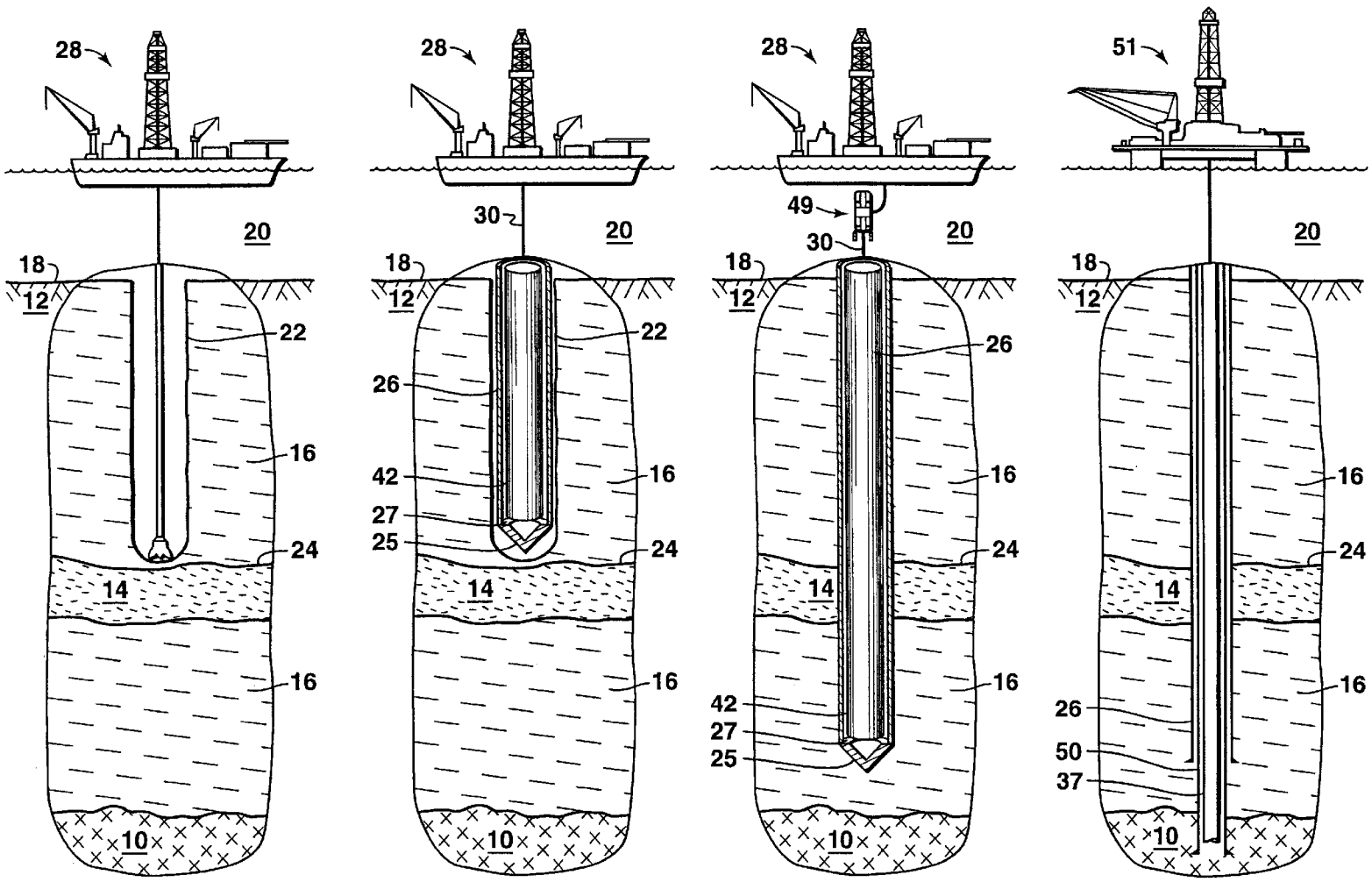
FIGS. 2A through 2D illustrate an exploded view of a second embodiment of the method of the present invention. In this embodiment a mandrel is inserted into the tubular member and contacts the tubular member in one or more locations near the lower end of the tubular member. A driving force is applied to top of the mandrel, thus allowing an interval of the tubular member to be driven through the over-pressured sand region.

FIGS. 2A through 2D illustrate a second embodiment of the inventive method for inserting tubular members 26 through an over-pressured sand region 14 (or regions; only one over-pressured region 14 is illustrated in FIGS. 2A through 2D). In this embodiment, an oversized borehole 22 is drilled, as previously described, to a depth proximate the top 24 of, but not into, the over-pressured sand region 14 of the earth 12. Referring now to FIG. 2B, the well casing 26 joints will be hung-off a drill vessel 28, connected and inserted into the borehole 22, wherein the closed lower end 27 of the well casing 26 is positioned proximate the top 24 of the over-pressured sand region 14 of the earth 12. A closure plate 25 (preferably conical; however other shapes could be used including, without limitation, a flat plate) can be used to close the lower end 27 of the well casing 26. A granular, cement, grout or concrete plug can also be used to close the lower end 27 of the well casing 26.

Figure 3A:
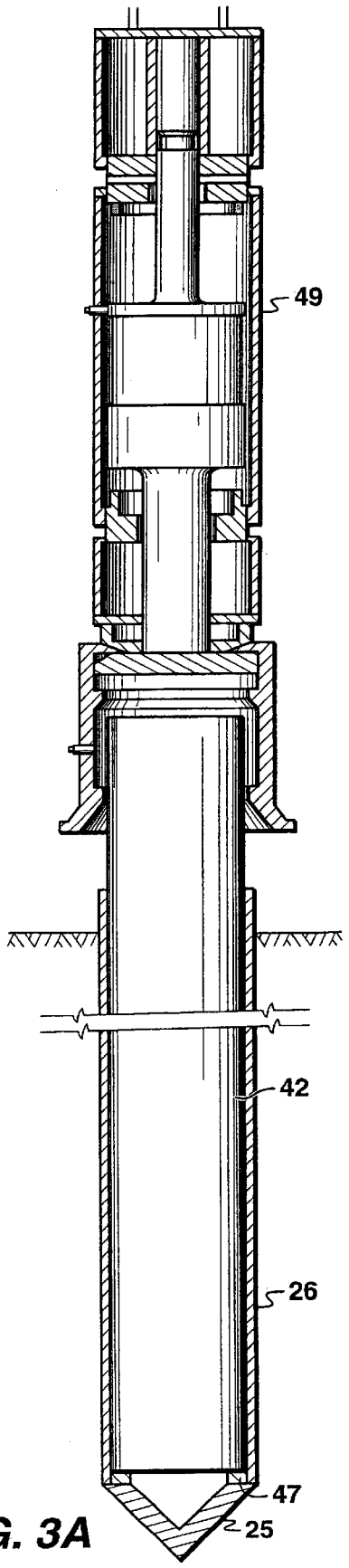
FIGS. 3A and 3B illustrate mandrels (straight and stepped, respectively) useful in the application of an embodiment of the method of the present invention.
Figure 3B:
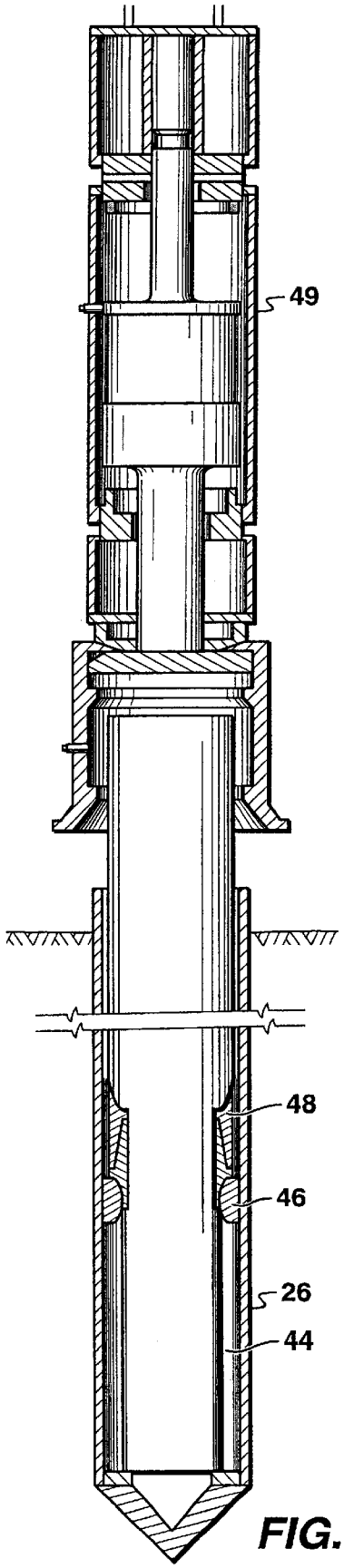

A force transmission means (mandrel 44 as illustrated in FIG. 3B or 42 as illustrated in FIGS. 2B, 2C and 3A) is installed in the well casing 26. Referring now to FIG. 3A, the well casing 26 can include a drive shoe means 47 wherein the force transmission means is adapted to engage with the drive shoe means 47. Alternately, the drive shoe means 47 can be integral to the closure plate 25. Referring now to FIG. 3B, driving rings 46 can be attached inside the well casing 26 to engage the force transmission means: One method for adapting the force transmission means to transmit the driving force to at least one location along the well casing 26 is to vary the diameter of the force transmission means in a step wise configuration. The different segments of the force transmission means would be attached with a mechanical connector 48 that can transmit driving forces. At the same location in the tubular member where these connectors 48 are positioned after the force transmission means is inserted, the well casing 26 is fitted with a driving ring 46 that is designed to fit to the geometry of the connector 48. Engaging the force transmission means at more than one location [e.g., the drive shoe means 47 and/or the driving ring(s) 46] may be more effective in installing the well casing 26. The force transmission means can be comprised of a mandrel (42 or 44) that has a constant or variable diameter, or one that is expandable (not shown). The constant diameter mandrel 42 (FIG. 3A) can be used to mate to the drive shoe means 47, and the variable diameter mandrel 44 (FIG. 3B) can be used to mate to the drive shoe means 47 and the drive ring(s) 46. The expandable mandrel can be used to mate to the drive shoe means 47 and drive rings(s) 46 or can be mechanically attached by "press-fitting" to the inside wall of the tubular member 26.

Referring now to FIG. 2C, a driving force is applied to the force transmission means (mandrel 42 in FIGS. 2B, 2C, and 3A or mandrel 44 in FIG. 3B) and then transferred to the casing 26 through the drive shoe means 47 and/or drive ring(s) 46, whereby an interval of the well casing 26, including the lower end 27, is driven through the over-pressured sand region 14 of the earth 12. An underwater hammer or driving mechanism 49, which is positioned on top of the force transmission means 42 or 44, can be used to impart the driving force. Once the well casing 26 is driven through the over-pressured sand region 14, the force transmission means 42 or 44 can then be removed from the well casing 26 and the closure plate 25 can be drilled through. As shown in FIG. 2D, one or more additional casing strings 50 and/or a production tubing string 37 can then be installed inside the well casing 26 for production of hydrocarbons from the subterranean reservoir 10 to a production facility 51.

The use of a force transmission means, such as a mandrel (42 or 44 in FIGS. 3A and 3B, respectively) and drive shoe means 47 and/or drive ring(s) 46 and connectors 48 to drive the well casing 26 increases the driving impedance ($I_d$=EA/c) of the well casing 26 being driven (i.e., combination of mandrel 42 or 44 and the well casing 26) and thus increases the penetration the well casing 26 can be driven. In addition, more energy is ultimately transferred to the invervals of higher soil resistance, which generally acts along the lower portion of the well casing 26, in contrast to a top-driven casing which has more of its energy dampened before it reaches the intervals of higher soil resistance. This capacity to increase the energy transmitted to the intervals of higher soil resistance also increases the penetration the well casing 26 can be driven into the earth 12.

Similarly to the composite casing embodiment, broaching is prevented both externally and internally to the well casing 26. The closure plate 25 on the lower end 27 of the well casing 26 prevents sand flow into the well casing 26 string. The natural bonding between the wall of the well casing 26 and the soil prevents sand flow from occurring outside the well casing 26. This method may be more cost effective than the previously described composite casing embodiment when installing individual wells, for example a subsea completion. When using this embodiment, the well casing 26 string can be driven as soon as it is lowered into the borehole 22 and the mandrel (42 or 44) is inserted, thereby eliminating the potential for delays to critical path time, as could occur using a cement filled composite casing for a single well installation. This embodiment also benefits from selecting a location where the sand has a high degree of overpressure, since installation is by driving.

The various embodiments of the present inventive method described herein may also be used in combination with the "Simultaneous Drive-Drill" technology (hereinafter "SDD technology"), described in U.S. Pat. No. 5,456,326 which is hereby fully incorporated by reference for purposes of U.S. patent practice. The SDD technology permits the controlled installation of a tubular member by simultaneously or sequentially driving, drilling and jetting, and it reduces the overall soil resistance so the target penetration of the well casing can be obtained by conventional top-driving. The SDD technology controls the frictional resistance during driving so that adequate resistance exists between the formation soils and the external wall of the casing and so the fracture integrity of the soil near the casing is maintained or increased.

The SDD technology prevents broaching both externally and internally to the well casing, but does not employ a means to close the shoe of the well casing as in the first and second embodiments of the inventive method described herein. Instead, the SDD technology maintains a partial soil plug inside the casing during installation to help provide a relatively impermeable barrier to prevent flow out of the over-pressured sands. Introducing mud based drilling fluids into the SDD drilling system can enhance the viability of the soil plug to prevent flow. The bond that forms between the outside of the casing and the soil maintains the integrity of the formation and thereby prevents broaching external to the casing.

This SDD technology may be more cost effective than the composite casing embodiment previously described when installing individual wells and technically more effective where multiple over-pressured sand layers are separated by distinct clay intervals on the order of 50 feet thick or more. These clay intervals could increase the SDR sufficiently such that neither the composite casing embodiment nor the mandrel-driven casing embodiment may be capable of installing a section of the well casing through multiple sand layers. The SDD technology permits drilling through the clay layers, thereby reducing the SDR and increasing the likelihood that the casing section can be installed through all layers. It is also possible to gain additional penetration by first using the SDD technology until refusal is reached and then filling the casing with a filler material (as in the composite casing embodiment) and continuing with the installation to casing TD or second refusal.

The various embodiments of the inventive method described herein are designed to prevent broaching of over-pressured sand region(s) 14 both externally and internally to the well casing 26. The fracture integrity of both the surrounding soils, often clay, and the over-pressured sand region(s) 14 are maintained or enhanced because contact is maintained between the soil and the well casing 26 during installation. As a result, an adhesive bond is formed between the wall of the well casing 26 and the clay, thereby preventing broaching of the over-pressured sands 14 along the outside of the well casing 26. Internally, the flow of the over-pressured sands is prevented either mechanically with a concrete or steel closure plate 25, or by a combination of a soil plug and drilling fluid. Thus, by not having to rely on control of formation fluid pressures by conventional drilling and cementing practices, the various embodiments of the inventive method described herein offer greater control of a potential sand flow, and thus significantly reduce the potential risk for well and foundation failure. The ultimate advantages of this inventive method are: (1) preventing flow both externally and internally to the well casing 26, thereby eliminating the loss of foundation support for the production facility due to broaching; and (2) preventing buckling of the well casing 26 due to loss of soil support.

In general, the various embodiments of the inventive method described herein are suitable for many of the same applications, but there may be circumstances where one embodiment (or a combination of embodiments) is more applicable than the others. The basis for determining the most applicable method may be technical, cost, schedule or a combination of these factors. The following example problems demonstrate how the proposed embodiments of the inventive method are capable of installing casing (or other tubular members) through at least one over-pressured sand region 14 while effecting an impermeable seal both above and below the over-pressured regions 14. The examples also demonstrate that the proposed method is superior to the current state of the practice for conventional top-driven casing.

EXAMPLES

Prior to discussing examples of the various embodiments of the inventive method it will be helpful to identify the following terms:

(1) Static-component of Driving Resistance (SDR)

The portion of the soil resistance to driving that is not rate-dependent. In the idealized situation, this is the axial compression capacity of the tubular member at the time in question.

(2) Soil Set-up

The gain in strength of the soil that is observed to occur after the driving of the tubular member is halted.

(3) Wave Equation Analysis

An analysis that idealizes driving of a tubular member as a sequence of impacts and wave transmissions of a stress wave in a one-dimensional rod. The analysis provides a number of hammer blows/unit penetration that is required to overcome a given value of SDR. This analysis accounts for hammer energy, cushion properties, tubular member geometry, and soil characteristics.

(4) Drivability Study

An analysis to determine the most appropriate hammer and pile/casing geometry for a given soil profile. The analysis uses wave equation results and the calculated SDR to make this determination.

In these examples, the Drivability Study is used to determine the most likely well casing penetration that can be obtained using standard casing sizes and available underwater driving hammers for two deepwater GOM soil profiles having over-pressured sand layers. The Drivability Study uses Wave Equation Analysis results and the calculated SDR to make the assessment.

To establish the viability of installing a tubular member by driving, it is necessary to satisfy a two-part driving criteria. First the hammer should have sufficient energy, with adequate reserve, to install the tubular member without driving interruption. Typically, when driving piling or casing in locations having an established driving history, the refusal criteria for continuous driving are defined as 150 blows/foot for five consecutive feet, and the hammer must be able to restart driving of the casing after at least a few hours interruption, should mechanical failure or weather cause a delay. For the classification of hammers used in the following examples (underwater hydraulic) driving blow counts as high as 500 blows/foot or higher are typically acceptable for the first foot of driving after an interruption.

To aid in demonstrating the claims of the embodiment, several example problems are posed that are typical of the over-pressured stratigraphies found in deepwater GOM. While the thickness and number of sand layers vary from location to location in the GOM, the profiles and data used in the example problems are characteristic of one of the most troublesome well drilling locations experienced to date. These data and the methodology for evaluating the utility of the embodiment are presented in FIGS. 4 through 6.

Figure 4B:
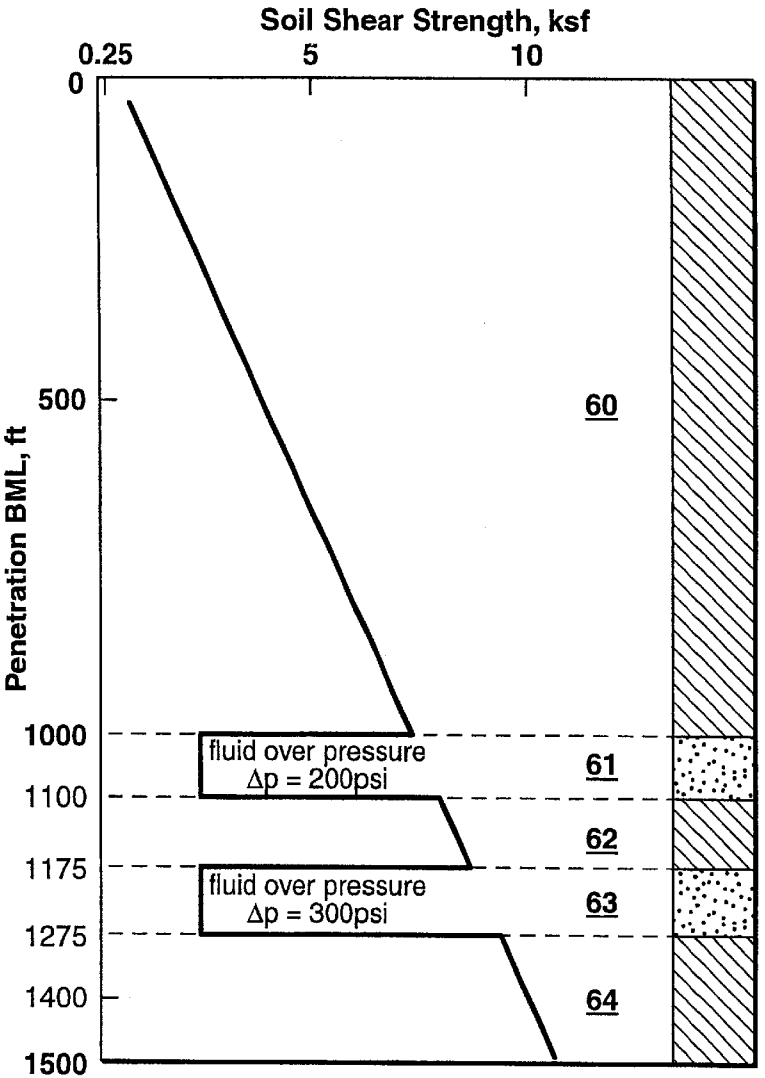
FIGS. 4A and 4B are Soil Shear Strength Profiles [soil shear strength (ksf) in relation to penetration BML (ft.)] for the Example I soil stratigraphy (FIG. 4A) and the Example II soil stratigraphy (FIG. 4B).
Figure 4A:
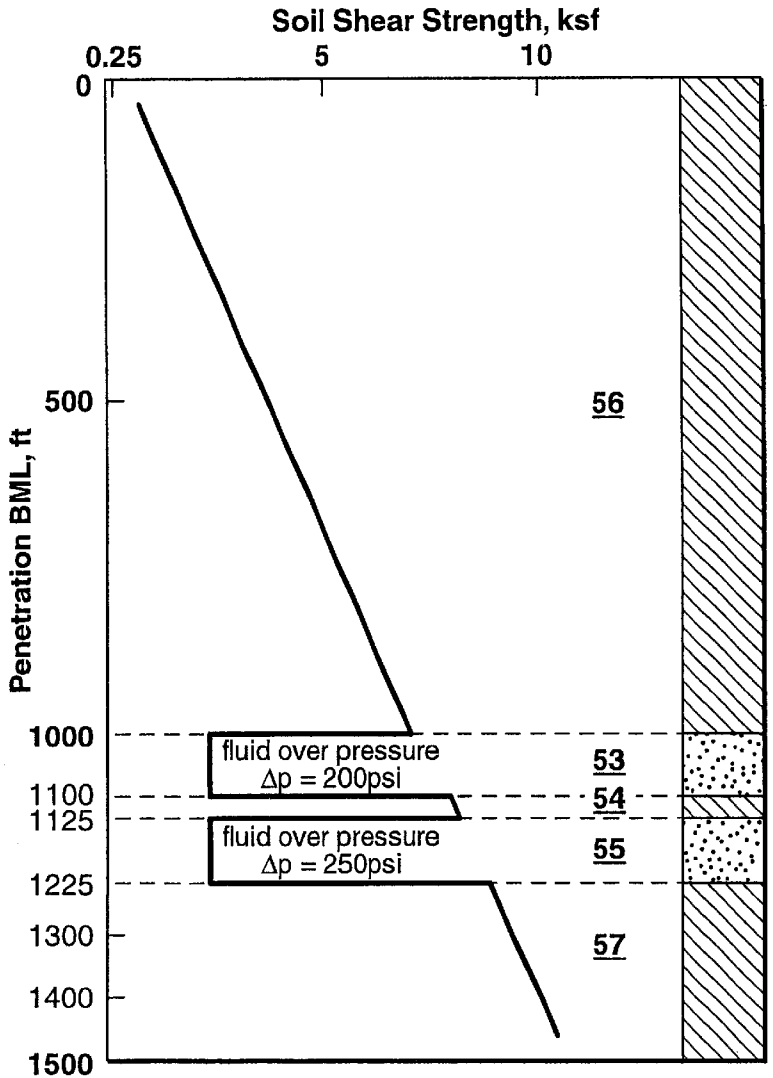

FIGS. 4A and 4B are Soil Shear Strength Profiles that are characteristic of deepwater locations in the GOM. These Figures plot soil shear strength (ksf) [x-axis] in relation to penetration BML (feet) [y-axis] and show the fluid over-pressure in each sand layer. In practice, these plots are developed from insitu and laboratory measurements of soil shear strength and insitu pore pressure. These plots are used to develop the SDR Profiles in FIGS. 5A through 5D.

FIGS. 5A through 5D are plots of SDR (kips) (x-axis) versus casing penetration BML (feet) (y-axis). The relationship between SDR and casing penetration is calculated using the following equation:

$$SDR=\{\theta_1\psi_1\}[(\text{soil skin friction})\times(\text{casing diameter})\times(\text{casing length } BML)]+\{\theta_2\psi_2\}[(\text{soil bearing factor})\times(\text{soil shear strength})\times(\text{casing cross-sectional area})]$$

Where:

Soil skin friction=f (soil shear strength)

$\theta_{1,2}$=Shear strength reduction factors to account for loss of skin friction and end bearing, respectively, in the clay soils during driving. ($0<\theta\leqq 1$);

$\psi_{1,2}$=Shear strength reduction factors to account for reduction in skin friction and end bearing, respectively, in the sand layers due to formation overpressure ($0<\psi\leqq 1$); and Casing diameter=30 inches.

Theta ($\theta_{1,2}$) are variables that are a function of soil type, the details of the driving operation (e.g., the number and duration of driving interruptions), and the method of installation (e.g., driving or combination of driving and jetting). $\psi_{1,2}$ are variables that are a function of formation overpressure and is independent of the method of installation or the details of the driving or drilling operation. The overpressure of the formation can vary arealy and therefore should be measured on location to determine the most appropriate value. These factors account for the different SDR curves in FIGS. 5A through 5D. FIG. 5A (Example I Soil Stratigraphy) and FIG. 5B (Example II Soil Stratigraphy) are plots of the SDR (kips) in relation to the penetration BML (feet) for the composite casing and the mandrel driven embodiments of the present invention, as well as for a conventional top-driven casing. FIG. 5C (Example I Soil Stratigraphy) and FIG. 5D (Example II Soil Stratigraphy) are plots of SDR (kips) in relation to the penetration BML (feet) for the SDD Technology.

Figure 5B:
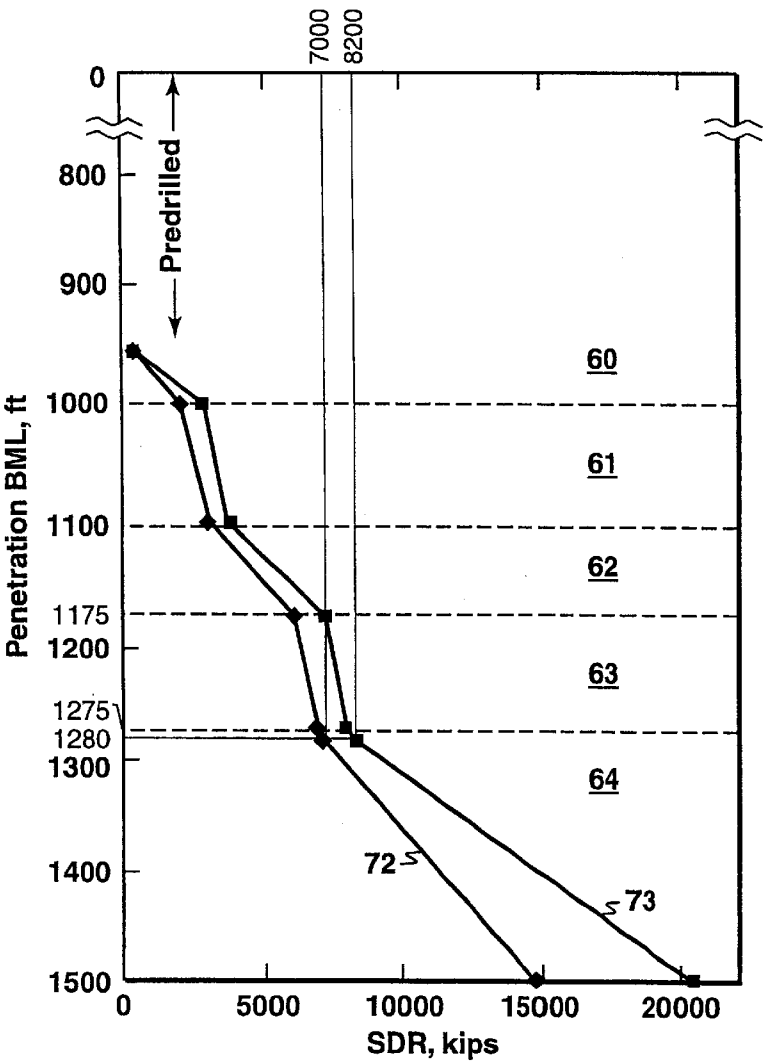
FIGS. 5A through 5D are static-component of driving resistance ("SDR") Profiles [SDR (kips) in relation to the penetration BML (ft.)] for the examples described herein.
Figure 5A:
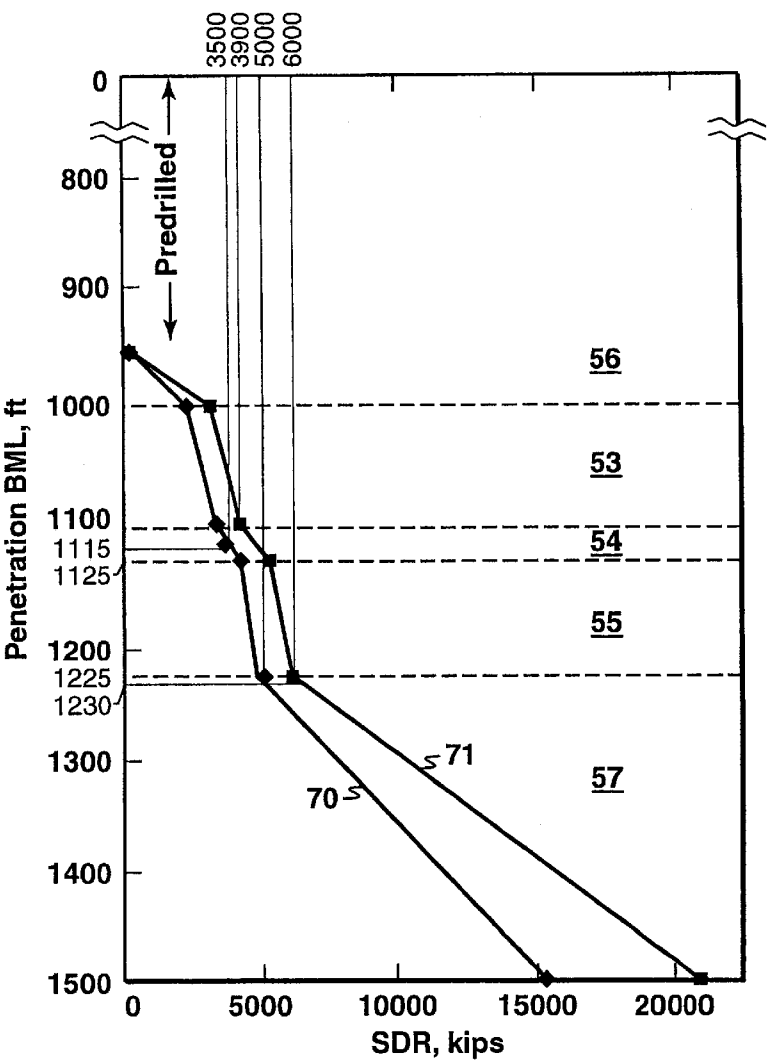
Figure 5D:
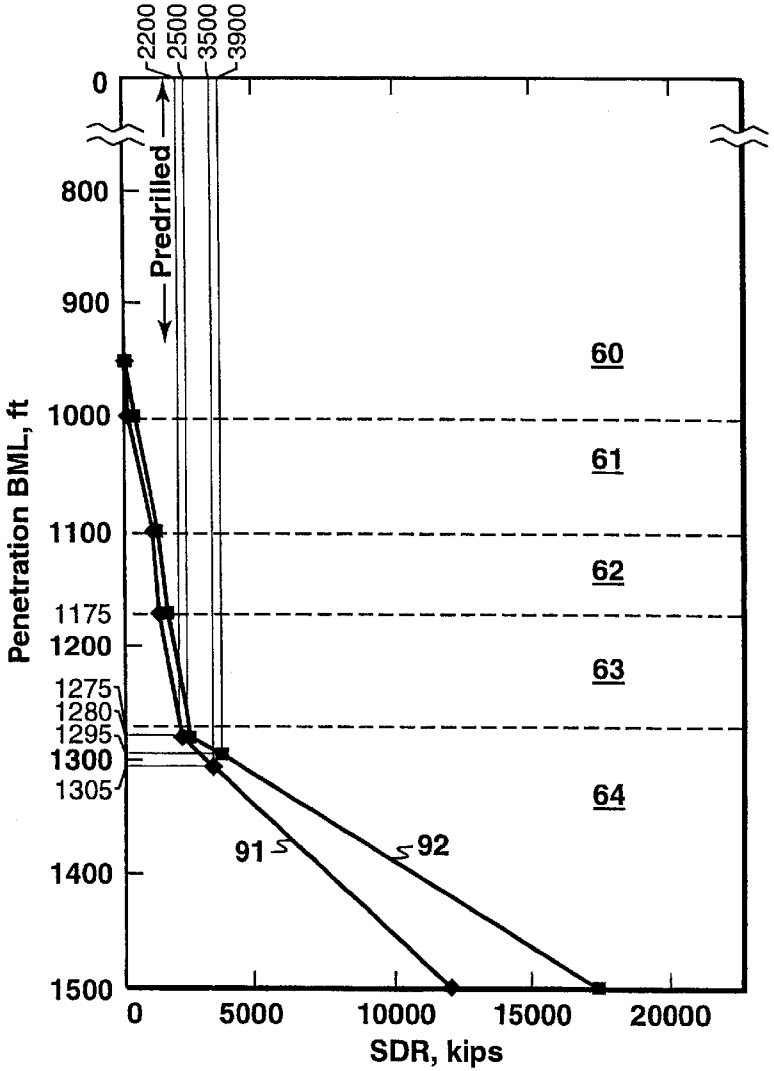
Figure 5C:
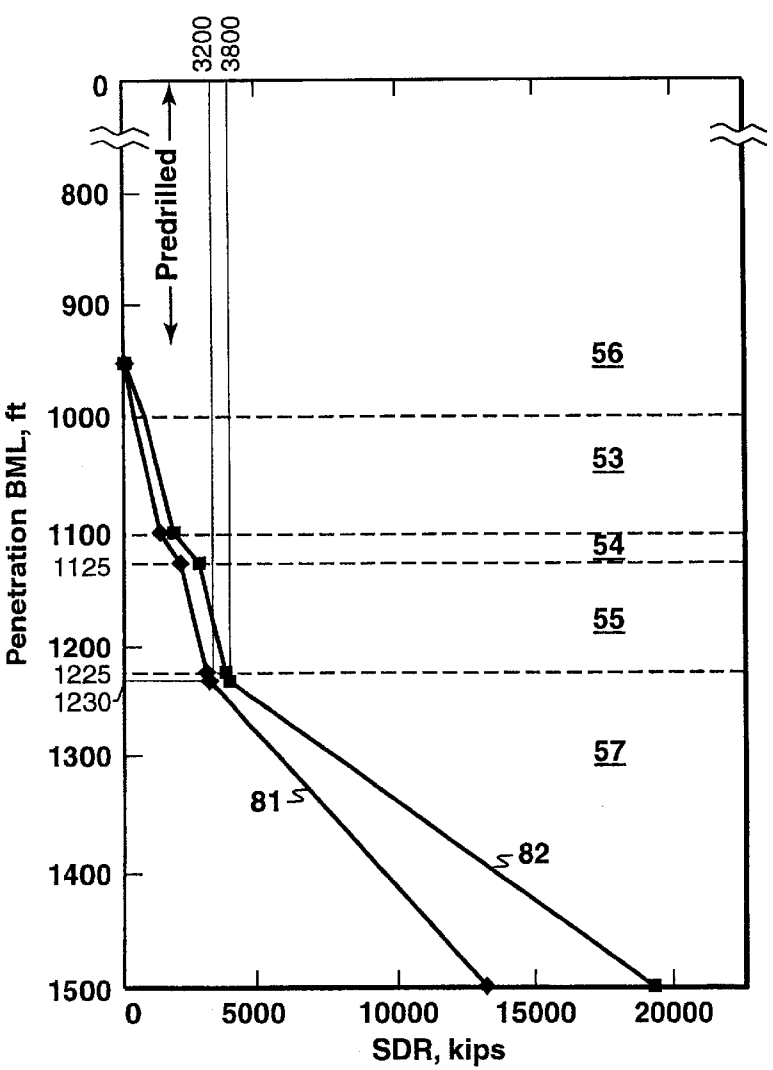
Figure 6A:
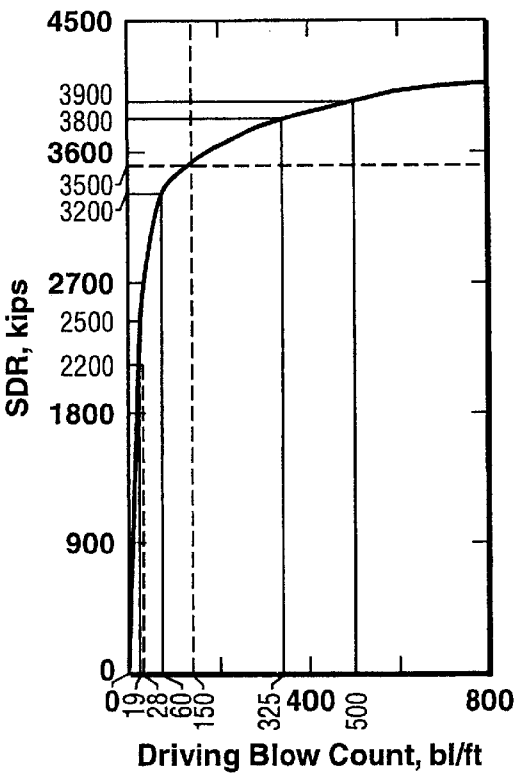
FIGS. 6A through 6C illustrate the Wave Equation Analysis Results [SDR (kips) in relation to penetration BML (ft.)] for the: conventional top driven casing and SDD installed casing (FIG. 6A); composite casing embodiment (FIG. 6B); and the mandrel-driven casing embodiment (FIG. 6C).
Figure 6B:
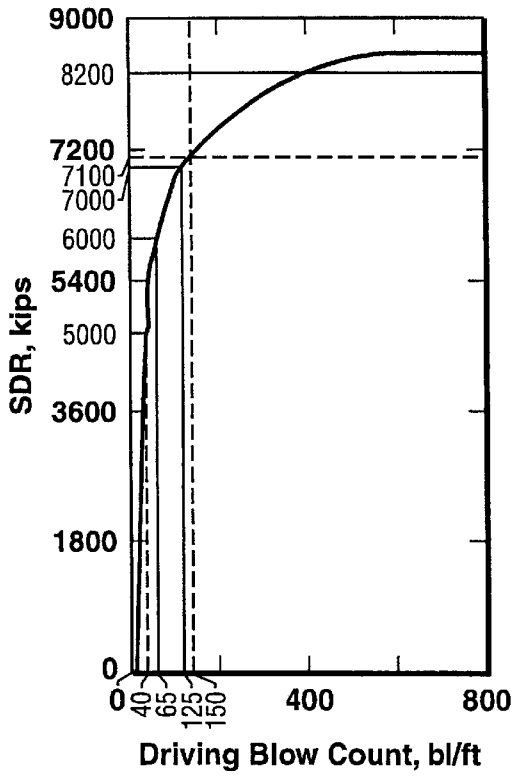
Figure 6C:
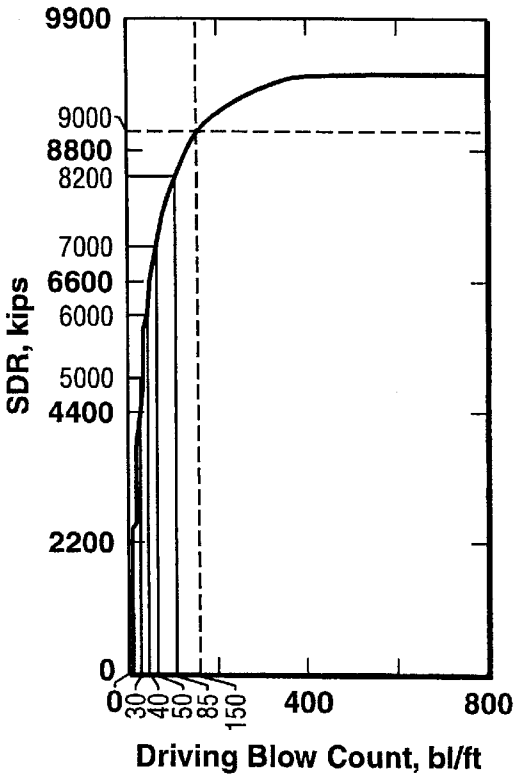

Finally, FIGS. 6A, B, and C illustrate the results of Wave Equation Analysis as SDR (kips) (y-axis) in relation to driving blow count (blows per foot) (x-axis) for the various embodiments. These include the SDD installed casing (FIG. 6A), the composite casing (FIG. 6B), and the mandrel-driven casing (FIG. 6C). The Wave Equation Analysis establishes the relationship between the SDR (kips) reacting against the well casing during installation and the driving blow counts. Once the driving blow counts for casing refusal have been established (see definition for "Drivability Study"; in these Examples, 150 blows per foot for continuous driving and 500 blows per foot for interrupted driving), then one can enter FIGS. 5A through 5D and determine, for the particular embodiment, the penetration to which the casing can be installed. Then by inspection it can be determined if the proposed embodiment is capable of safely penetrating the over-pressured sand region or regions.

Example I

FIG. 4A illustrates the Soil Shear Strength Profile for the Example I soil conditions, which includes two over-pressured sand layers (53 and 55). The first sand layer 53 begins at 1000 feet BML, ends at 1100 feet BML, and has a fluid over-pressure of $\Delta P$=200 psi. A clay layer 54 extends from the bottom of the first sand layer 53 to about 1125 feet BML, where the second sand layer 55 begins. The second sand layer extends about 100 feet to a depth of 1225 BML and has a fluid over-pressure of $\Delta P$=250 psi.

For these soil conditions, it is necessary to penetrate through both sand layers 53 and 55 (to about 1230 feet BML) with one casing string because of the risk of communication of the higher pressure in the second sand layer 55 with the first layer 53. Should communication occur between the sand layers 53 and 55, then typically the pressure integrity of the clay 56 above the first sand layer 53 is not sufficient to prevent broaching of fluid from the second sand layer 55. The potential for exceeding the pressure integrity of the clay 56 above the first sand layer 53 is exacerbated by the likelihood of thin sand lenses located between the two layers. The fluid pressure in these lenses will be intermediate to that in the two layers, but still may be sufficient to exceed the fracture integrity of the clay 56 above the first sand layer 53. Thus, it is important to penetrate both sand layers 53 and 55 with one casing string, and to maintain formation integrity between the two sand layers 53 and 55, in addition to maintaining integrity above and below both sand layers (in clay layers 56, 54, and 57)

First a Drivability Study will be presented for a conventional top-driven casing to illustrate that the conventional approach cannot achieve the desired goal of safely penetrating the second over-pressured sand layer for this Example I soil stratigraphy. Following that discussion, it will be demonstrated that the various inventive embodiments described herein can achieve this objective. In both cases, the discussion will rely on FIGS. 5 and 6 to help illustrate the findings.

Example I

Conventional Top-Driven Casing

FIG. 5A illustrates the SDR Profile for the Example I soil stratigraphy. In performing a Drivability Study, FIG. 5A is entered at a penetration safely below the over-pressured sand layers 53 and 55, say 1230 feet, and the corresponding SDR is read directly from FIG. 5A. In this Example I, that corresponds to SDR values of approximately 5000 kips for continuous driving (as illustrated by curve 70) and 6000 kips for driving after interruptions (as illustrated by curve 71). Looking at the wave equation analysis curve for the top-driven casing, FIG. 6A shows that the two-part driving refusal criteria (i.e., 150 blows/foot for continuous driving and 500 blows/foot for interrupted driving, as defined earlier) occurs at approximately 3500 kips for continuous driving and at approximately 3900 kips for driving after an interruption. As described further below, for the conditions assumed and referring to FIG. 6A, the refusal will occur well short of the 5000 kips needed for continuous driving and the 6000 kips needed for interrupted driving: Thus the well casing will refuse well short of the target penetration of 1230 feet.

It is instructive to estimate the penetration of the conventional top-driven casing because it provides insight into how precarious it could be to use current technology, and why it is generally not considered. To obtain an estimate of casing penetration, one enters FIG. 5A with the values of 3500 and 3900 kips, the SDR values corresponding to the two-part driving refusal criteria, and reads the corresponding penetrations, approximately 1115 and 1100 feet, respectively, directly from the appropriate curves. For the continuous driving criteria, the casing can be driven through the first sand layer 53, but will refuse at the interface with the second layer 55. More critically, if interruptions to driving occur, then the casing will likely refuse near the interface between the first sand layer and the intermediate clay layer 54. This would not be an acceptable design condition because under these circumstances there is a low likelihood of maintaining a seal around the casing shoe.

Example-I

Composite and Mandrel-Driven Casings

Using the same analysis methodology as for the conventional top-driven casing, it can be demonstrated that the various embodiments of the inventive method described herein can easily satisfy the objective of driving through both sand layers 53 and 55. Again SDR values of approximately 5000 kips for continuous driving and 6000 kips for driving after interruptions need to be accommodated to achieve a design penetration of approximately 1230 feet. Entering FIG. 6B (which is the plot of the Wave Equation Analysis Results for the composite casing embodiment of the inventive method) at 5000 and 6000 kips indicates driving blow counts of approximately 40 blows/foot and 65 blows/foot, respectively, indicating ample reserve capacity to drive the casing to penetrations beyond 1230 feet. For the mandrel driven casing as shown in FIG. 6C, the corresponding driving blow counts at SDR values of 5000 and 6000 kips are approximately 30 blows/foot and 40 blows/foot, respectively. Thus these embodiments satisfy the objective of setting the casing to penetrations beyond both sand layers.

Referring now to FIG. 5C, which is the SDR profile for the Example I soil stratigraphy for the SDD technology, the SDD technology can also be used to drive the casing through both sand layers 53 and 55. In the interval between 950 and 1000 feet BML (i.e., before the first sand layer 53), a drill bit and under-reamer would be positioned in front of the casing shoe to reduce the SDR, except for the last 10 to 15 feet of the interval, where it would be operated inside the well casing so that pressure integrity could be maintained in the wellbore. In the event that thin interbedded layers of sand are encountered above 1000 feet BML, drilling would temporarily be halted and the casing driven past the sand, sealing the over-pressured interval. As shown in FIG. 5C, this procedure reduces the total SDRs to reach the 1230 target penetration to approximately 3200 kips (versus 5000 kips in FIG. 5A) for continuous driving (as illustrated by curve 81) and to 3800 kips (versus 6000 kips in FIG. 5A) after an interruption to driving (as illustrated by curve 82). Entering the wave equation analysis in FIG. 6A at 3200 kips and 3800 kips will correspond to 60 blows per foot and 325 blows per foot for continuous and interrupted driving, respectively. This confirms that the SDD technology is capable of installing the casing in accordance with the two-part driving criteria (i.e., 150 blows/foot for continuous driving and 500 blows/foot for interrupted driving, as defined earlier). As a precautionary measure, to minimize the potential for fluid from the over-pressured formations to broach along the outside of the casing, the casing can be perforated and squeeze cemented, to fill any void between the casing wall and the soil, in the interval that was drilled above 1000 feet BML.

In this example, there are also additional benefits to achieving adequate penetration of the casing below the second sand layer. The first benefit, preserving the integrity of the formation, is discussed above. A second one, preserving the planned well casing profile and the size of the production tubing, has significant cost and schedule benefits. In the example of the conventional top-driven casing, even if the casing could be set safely between the sand layers, additional casing sizes would be required at extra expense, because the setting depth would be higher than planned. In that event, it is likely the production tubing would also have to be reduced to accommodate the additional casing. Thus, the planned daily oil or gas production would be reduced, resulting in lost revenues. Finally, if additional casing strings are required, the time for installing increases, resulting in significantly higher drilling costs.

Example II

The second example problem represents a more extreme condition with regard to the spacing of the over-pressured sand layers: The Soil Shear Strength Profile for the Example II soil stratigraphy is illustrated in FIG. 4B. Again there are two sand layers 61 and 63, but in this example a hundred feet separates the two sand layers (i.e., clay layer 62), which represents the largest known spacing in a given geologic unit as found to date in the GOM. For these soil conditions, the option likely exists to either set casing approximately half way between the sand layers 61 and 63, or to drive through both sand layers 61 and 63 and set casing in the underlying clay 64. This decision would likely be influenced by several factors, including the casing design, oil/gas production goals, the stratigraphy below 1500 feet BML, and drilling costs. In all likelihood, however it will be most advantageous from a cost and production perspective to penetrate both sand layers 61 and 63 with the same casing string.

To evaluate the utility of the composite casing embodiment and the mandrel-driven casing embodiment of the present invention, an SDR profile for the FIG. 4B soil profile was prepared and plotted in FIG. 5B. This plot shows that SDRs of approximately 7000 kips and 8200 kips will have to be achieved during both continuous driving (as illustrated by curve 71) and after an interruption to driving (as illustrated by curve 73), respectively, to penetrate the casing by at least five feet through both sand layers 61 and 63 (i.e., to approximately 1280 feet BML). Entering the wave equation analysis in FIGS. 6B and 6C at 7000 kips and 8200 kips shows both the composite casing (FIG. 6B) and the mandrel-driven casing (FIG. 6C) can achieve these criteria at driving blow counts of approximately 125 and 400 blows per foot, and 50 and 85 blows per foot, respectively. The conventional top-driven casing was shown to be inadequate in the first example, and therefore would also be inadequate for this soil profile.

The SDD technology can also be used to install casing in the soil profile shown in FIG. 4B, by using a procedure similar to the one in Example I. Initially, the installation would be the same as in Example I to about 1110 feet BML, approximately 10 feet into the intermediate clay interval 62.

At that penetration the drill bit and under-reamer would be advanced to a position in front of the casing shoe and the casing advanced by SDD to within 10 to 15 feet of the second sand layer 62. At that time the drill bit and under-reamer will be pulled inside the casing and the casing advanced by SDD until it penetrates through the sand 63 and into the underlying clay 64. Drilling in front of the shoe would eliminate the SDR in the intermediate clay interval 62, except right below the first layer 61 and right above the second layer 63, where the drill bit and under-reamer would remain inside the casing to maintain formation integrity and prevent communication between the two layers. As shown in FIG. 5D the total SDRs at 1280 feet reduce to about 2200 kips during continuous driving (as illustrated by curve 91) and to about 2500 kips after an interruption to driving (as illustrated by curve 92). Entering the wave equation results in FIG. 6A at SDR values of 2200 and 2500 kips will correspond to driving blow counts of 19 and 28 for continuous and interrupted driving, respectively, which confirms that the two-part driving criteria can be satisfied and the casing can be installed to a penetration of at least 20 feet below the second sand layer. As noted in Example I, the casing can be perforated and cement squeezed in the intervals where drilling was in front of the casing shoe, should it be necessary to increase the fracture integrity along the casing wall.

Finally, it is possible to combine the SDD technology and the composite casing technology to install a casing to a deeper penetration than obtainable with either technology alone. This "combined technology" can be used in the following manner. First, the casing is installed as far as possible using the SDD technology. In Example II above, that corresponds to at least 1305 feet for continuous driving (as illustrated by curve 91) or 1295 feet for driving after interruptions (as illustrated by curve 92) (FIG. 5D), based on the driving refusal criteria (FIG. 6A) of 150 blows/foot and 500 blows/foot, corresponding to a SDR of 3500 kips and 3900 kips, respectively. To illustrate, FIG. 6A indicates that driving refusal for continuous driving with the SDD technology is reached at an SDR of approximately 3500 kips (at 150 blows per foot). If at this time the SDD technology is removed and the casing is filled with cement or granular material, then driving can be continued because the impedance of the casing has been increased and the wave equation analysis curve in FIG. 6B is now appropriate to apply. By comparing FIGS. 6A and 6B, it can be seen that the difference in SDR between the composite casing embodiment and the standard casing installed with SDD technology is approximately 3600 kips (at 150 blows per foot). Consequently, if a third one hundred foot thick sand layer existed 25 feet below the second sand layer 63 in Example II (FIG. 5D), then by calculation all three sand layers could be penetrated with the casing. This could be accomplished by first using SDD technology until refusal is reached, filling the casing with cement or granular material, and finally continuing with driving.

The embodiments of the inventive method described herein achieve the objectives of developing a strong frictional resistance between the soil and external wall of a well casing, maintaining or enhancing the fracture integrity immediately adjacent to the casing in the soil formations surrounding the over-pressured sands, minimizing the potential for broaching along the outside of the well casing, preventing casing separation (e.g., can occur if the casing buckles) and ultimately sand flow from within the casing, minimizing the potential for foundation failure due to broaching, preventing the buckling of the well casing as a result of loss of soil support due to large sand flows, and if desirable, providing a conduit for draining the excess water pressure in the sands.

It should be understood that the foregoing description is illustrative and that other embodiments of the invention can be employed without departing from the fall scope of the invention as set forth in the appended claims.

What I claim is:

1. A method for installing a tubular member axially into the earth, said tubular member having an upper end and a closed lower end, said method comprising the steps of:

(a) inserting said tubular member into the earth;

(b) inserting a filler material into at least a portion of said tubular member, thereby increasing the driving impedance of the tubular member; and (c) applying a force to said upper end of said tubular member, whereby said tubular member is driven further into the earth.

2. A The method of claim 1 wherein said filler material is inserted to the top of said upper end of said tubular member and wherein said force is also applied to said filler material.

3. The method of claim 1 further comprising the steps of first drilling a borehole into the earth and inserting said tubular member into said borehole.

4. The method of claim 1 wherein said closed end of said tubular member comprises a pre-installed grout plug.

5. The method of claim 1 wherein said filler material is a granular material.

6. The method of claim 1 wherein said filler material is cement.

7. The method of claim 6 further comprising allowing said cement to set-up prior to applying said force to said upper end of said tubular member.

8. The method of claim 1 further comprising the step of drilling through said filler material and said closed lower end of said tubular member after said tubular member has been driven to target penetration.

9. The method of claim 1 wherein said tubular member comprises well casing, and wherein said method further comprises the step of installing a production tubing string inside said well casing after said tubular member has been driven into the earth, said production tubing string used for producing hydrocarbons from a subterranean reservoir.

10. The method of claim 1 wherein said tubular member comprises a pile.

11. A method for installing a tubular member axially into the earth, said tubular member having an upper end and a closed lower end, said method comprising the steps of:

(a) inserting said tubular member into the earth;

(b) installing a force transmission means into said tubular member, said force transmission means extending from a distance above said upper end of said tubular member to a distance below said upper end of said tubular member; said force transmission means adapted to transmit a driving force from a point above said upper end of said tubular member to said lower end of said tubular member, thereby increasing the driving impedance of the tubular member; and (c) applying a driving force to said force transmission means, whereby said tubular member is driven further into the earth;

(d) removing said force transmission means from said tubular member;

(e) drilling through said closed lower end of said tubular member.

12. The method of claim 11 further comprising the steps of first drilling a borehole into the earth and inserting said tubular member into said borehole.

13. The method of claim 11 wherein said force transmission means comprises a mandrel which is adapted to engage with a drive shoe means attached proximate said lower end of tubular member.

14. The method of claim 11 wherein said lower end of said tubular member further includes a drive shoe means, and wherein said force transmission means is adapted to engage with said drive shoe means.

15. The method of claim 11 wherein said lower end of said tubular member is closed by a closure plate.

16. The method of claim 11 wherein said tubular member comprises well casing, and wherein said method further comprises the step of installing a production tubing string inside said well casing after said tubular member has been driven into the earth, said production tubing string used for producing hydrocarbons from a subterranean reservoir.

17. The method of claim 11 wherein said tubular member comprises a pile.

* * * * *